US011851946B2

(12) United States Patent
Elrod

(10) Patent No.: US 11,851,946 B2
(45) Date of Patent: Dec. 26, 2023

(54) FLAP OPENING WITH ZIPPER FOR SCREENED ENCLOSURES AND METHODS OF MAKING

(71) Applicant: Access Screens LLC, Titusville, FL (US)

(72) Inventor: Richard Elrod, Titusville, FL (US)

( * ) Notice: Subject to any disclaimer, the term of this patent is extended or adjusted under 35 U.S.C. 154(b) by 35 days.

(21) Appl. No.: 17/731,041

(22) Filed: Apr. 27, 2022

(65) Prior Publication Data

US 2022/0251902 A1 Aug. 11, 2022

Related U.S. Application Data

(62) Division of application No. 16/535,796, filed on Aug. 8, 2019, now Pat. No. 11,332,975.

(51) Int. Cl.
*E06B 9/52* (2006.01)
*E04D 13/064* (2006.01)

(52) U.S. Cl.
CPC ..... *E06B 9/521* (2013.01); *E04D 13/064* (2013.01); *E06B 2009/524* (2013.01); *E06B 2009/527* (2013.01)

(58) Field of Classification Search
CPC ..... E06B 9/521; E06B 2009/524; E06B 2009/527; E04D 13/064
USPC ..... 52/79.1, 79.6, 765, 92.3, 203; 160/383, 160/384, 385, 180, 237, 371
See application file for complete search history.

(56) References Cited

U.S. PATENT DOCUMENTS

| | | | | |
|---|---|---|---|---|
| 2,837,153 | A | 6/1958 | Brown | |
| 2,883,712 | A | 4/1959 | Shelamer | |
| 3,251,399 | A | 5/1966 | Grossman | |
| 3,374,597 | A | 3/1968 | Whitener | |
| 3,763,917 | A | 10/1973 | Antinone | |
| 3,880,459 | A | 4/1975 | Kelley | |
| 4,265,190 | A * | 5/1981 | Moertel | A41H 37/003 112/152 |
| 5,038,530 | A | 8/1991 | Watkins | |
| 5,915,399 | A | 6/1999 | Yang | |
| 6,189,553 | B1 | 2/2001 | Barker et al. | |
| 6,296,003 | B1 * | 10/2001 | Howe | E04H 15/14 160/DIG. 18 |

(Continued)

FOREIGN PATENT DOCUMENTS

| | | | |
|---|---|---|---|
| CN | 2201840 Y | * | 6/1995 |
| CN | 203905776 U | * | 10/2014 |

(Continued)

*Primary Examiner* — Brent W Herring
(74) *Attorney, Agent, or Firm* — Brian S. Steinberger; Hilary F. Steinberger; Law Offices of Brian S. Steinberger, P.A.

(57) ABSTRACT

Zippered curved screen flap access panels, systems, arrangements, kits and methods for making a zippered curved screen flap panels in order to access space on another side of a screen enclosure. In a preferred embodiment, the novel curved screen flap can be formed in a screen panel, where the panel is installed in an upper location of a screen cage such as in a roof section or upper wall section below or adjacent to a roof gutter. The panel can be easily unzipped with the flap hanging down so that the gutter can be easily accessed and cleaned through the access opening. After the gutter is cleaned, the flap can easily be zippered back in place with the screen material being retensioned.

12 Claims, 7 Drawing Sheets

(56) References Cited

U.S. PATENT DOCUMENTS

| | | | | |
|---|---|---|---|---|
| 6,371,144 | B1 | 4/2002 | Ragatz | |
| 6,792,885 | B1 | 9/2004 | Peng et al. | |
| 7,047,992 | B1 * | 5/2006 | Fluellen | E04H 15/26 135/136 |
| 7,320,353 | B1 | 1/2008 | Miller et al. | |
| 7,913,741 | B1 | 3/2011 | Aulet | |
| 7,946,333 | B1 | 5/2011 | Zapata | |
| 9,352,636 | B1 * | 5/2016 | Johnson | B60J 1/20 |
| 9,556,671 | B1 | 1/2017 | Grimes | |
| 9,988,119 | B1 * | 6/2018 | Kay | B62J 19/00 |
| 2002/0062852 | A1 | 5/2002 | Jopp et al. | |
| 2003/0070221 | A1 | 4/2003 | Goldenberg et al. | |
| 2004/0173133 | A1 | 9/2004 | Peng et al. | |
| 2007/0119553 | A1 | 5/2007 | Guffey | |
| 2012/0324656 | A1 | 12/2012 | Shu | |
| 2014/0226920 | A1 * | 8/2014 | Passavia | B65D 81/261 493/214 |
| 2018/0179813 | A1 | 6/2018 | Sperber | |
| 2023/0019548 | A1 * | 1/2023 | Koontz, IV | A47C 7/622 |

FOREIGN PATENT DOCUMENTS

| | | | | | |
|---|---|---|---|---|---|
| CN | 205266663 | U | * | 6/2016 | |
| CN | 211942914 | U | * | 11/2020 | |
| DE | 102006039409 | A1 | * | 2/2008 | E06B 9/52 |
| DE | 202012102271 | U1 | | 7/2013 | |
| KR | 200202035 | Y1 | | 11/2000 | |
| KR | 200325928 | Y1 | | 9/2003 | |
| KR | 200358991 | Y1 | | 8/2004 | |
| KR | 200423904 | Y1 | | 8/2006 | |
| KR | 200433475 | Y1 | | 12/2006 | |
| KR | 20080006792 | A | | 1/2008 | |
| KR | 20090065589 | A | | 6/2009 | |
| KR | 20120002630 | A | | 1/2012 | |
| KR | 101659445 | B1 | | 9/2016 | |
| TW | 201440681 | A | * | 11/2014 | A44B 19/12 |
| WO | 2004088078 | A2 | | 10/2004 | |

* cited by examiner

FLAP OPENING WITH ZIPPER FOR SCREENED ENCLOSURES AND METHODS OF MAKING

CROSS REFERENCE TO RELATED APPLICATIONS

This application is a Divisional Application of U.S. patent application Ser. No. 16/535,796 filed Aug. 8, 2019, now U.S. Pat. No. 11,332,975, which is incorporated by reference in its' entirety.

FIELD OF INVENTION

This invention relates to screen enclosures, and in particular to zippered curved screen flap access panels, systems, arrangements, kits and methods for making a zippered curved screen flap panels in order to access space on another side of a screen enclosure, such as gutters above a screened enclosure attached to a house.

BACKGROUND AND PRIOR ART

Paneled screen enclosures attached to a side of a home are popular to enclose patios, decks, pools and the like. A common assembly of the panels can use spline material to fasten edges of the panels into grooves of surrounding frame members. See for example, U.S. Pat. No. 2,837,153 to Brown et al. and U.S. Pat. No. 3,374,597 to Whitener. A problem occurs in areas that can be difficult to access such as upper screen panels that are below drainage gutters.

If a horizontal roof edge gutter above a screen cage becomes full of debris, it can be difficult to access the gutter without having to climb on the roof or on top of the screen cage, which can be both difficult and dangerous.

Attempts have been made over the years to allow for some screen panels to be removeable. See for example, U.S. Pat. No. 5,038,530 to Watkins and U.S. Published Patent Application 2007/0119553 to Guffey. However, both these types of arrangements require panels to have hook and loop fasteners on the edges of the panels to reattach the screen panels, which may appear easy but is problematic.

One problem is that screen enclosure panels must be tightly stretched in order to be strong enough to handle weather conditions when installed and also to be aesthetically uniform with other panels. Having to manually position all four sides of a screen panel with hook and loop fasteners above one's head on a ladder and the like, would still be difficult and potentially dangerous to the installer. Additionally, it would be difficult to achieve a tight uniform tension across the installed panel to achieve the aesthetic uniform appearance with other panels that are attached by splines on their edges.

Thus, the need exists for solutions to the above problems with the prior art.

SUMMARY OF THE INVENTION

A primary objective of the present invention is to provide zippered curved screen flap access panels, systems, arrangements, kits and methods for making a zippered curved screen flap panels in order to access space on another side of a screen enclosure, such as gutters above a screened enclosure attached to a house.

A secondary objective of the present invention is to provide reusable, durable and long lasting screen flap access panels, systems, arrangements, kits, and methods for making a zippered curved screen flap panels in order to access space on another side of a screen enclosure, such as gutters above a screened enclosure attached to a house.

A method for making a zippered access panel for a screen enclosure, comprising the steps of preparing a screen panel for a selected frame opening in a screen enclosure, sewing a curved zipper in a mid-portion of the screen panel, and installing the screen panel with the sewn curved zipper into the selected frame opening in the screen cage.

The screen panel can include a generally rectangular shape. Additionally, the screen panel can include other geometrical shapes, such as but not limited to square shapes, triangular shapes, combinations of rectangular and triangular shapes, and the like.

The step of preparing the screen panel can include the step of cutting the screen panel into a rectangular configuration from a screen roll.

The step of preparing the screen panel can include the step of drawing a curved line in the mid-portion of the screen panel, and the step of sewing includes the sewing of the curved zipper over the drawn curved line.

The step of preparing the screen panel can include the steps of drawing a curved line in the mid-portion of the screen panel, and adhering and/or holding the curved zipper over the drawn line, and the step of sewing includes the sewing of the adhered curved zipper onto the screen panel.

The adhering step can include the steps of applying double sided tape side strips of the zipper and adhering the side strips of zipper with the double sided tape over the drawn line on the panel. Alternatively, zipper can be physically held in place by ones hand(s) until it is sewn in place.

The step of preparing the screen panel can include the steps of drawing a curved line in the mid-portion of the screen panel, and adhering or holding the curved zipper over the drawn line, and the step of sewing includes the sewing of the adhered or held curved zipper onto the screen panel, and cutting a cut line into the screen against the drawn line from an opposite side of the screen.

The zipper can include one zipper pull. The zipper can include two zipper pulls.

The installing step can include the step of applying spline against perimeter edges of the panel and into grooves along the frame in the screen enclosure.

The selected frame opening in the screen enclosure can be located adjacent to a roof gutter.

A method of installing an access door into a screen panel for a screen enclosure, can include the steps of sizing a selected screen panel, drawing a curved line having an upward extending convex curved edge in the selected screen panel, sewing a curved zipper over a front surface of the screen panel over the drawn curved line, cutting a curved opening matching the curved line through a rear surface of the screen panel, installing the selected screen panel with the sewn curved zipper into a framed opening of the screen enclosure adjacent to a gutter located outside of the screen enclosure, unzipping the zipper to cause the upward extending convex curved edge to turn into a flap where the upward extending convex curved edge falls downward creating an opening, and accessing the gutter through the opening in the screen panel caused by the flap falling downward.

The method can include the step of adhering or holding the curved zipper on the curved drawn line with an adhesive before the step of sewing the curved zipper against the drawn line.

The step of adhering can include the step of applying double sided tape between side strips of the curved zipper and the drawn line on the selected screen panel.

The installing step can include the step of attaching perimeter edges of the selected screen panel by placing spline against the perimeter edges and into grooves along side edges of the framed opening.

A zippered screen flap opening in a screen panel attached to a frame, can comprise a generally rectangular screen panel in the frame, a flap formed from a screen portion in a mid-portion of the screen panel, the flap having a bottom edge as part of the screen panel and an upward convex curved cut-out of the screen portion in the mid-portion of the screen panel, and a zipper sewn along the upward convex curved cut-out of the screen portion, wherein the zipper allows for the flap to fold downward forming an opening through the screen panel when the zipper is unzipped, and the zipper when zipped closed causes the flap to close the opening through the screen panel.

The zippered screen flap opening in the screen panel attached to the frame, can include a spline pushing perimeter edges of the screen panel into corresponding grooves along perimeter side portions of the frame, for attaching the screen panel to the frame.

The zipper can include one zipper pull. The zipper can include two zipper pulls.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
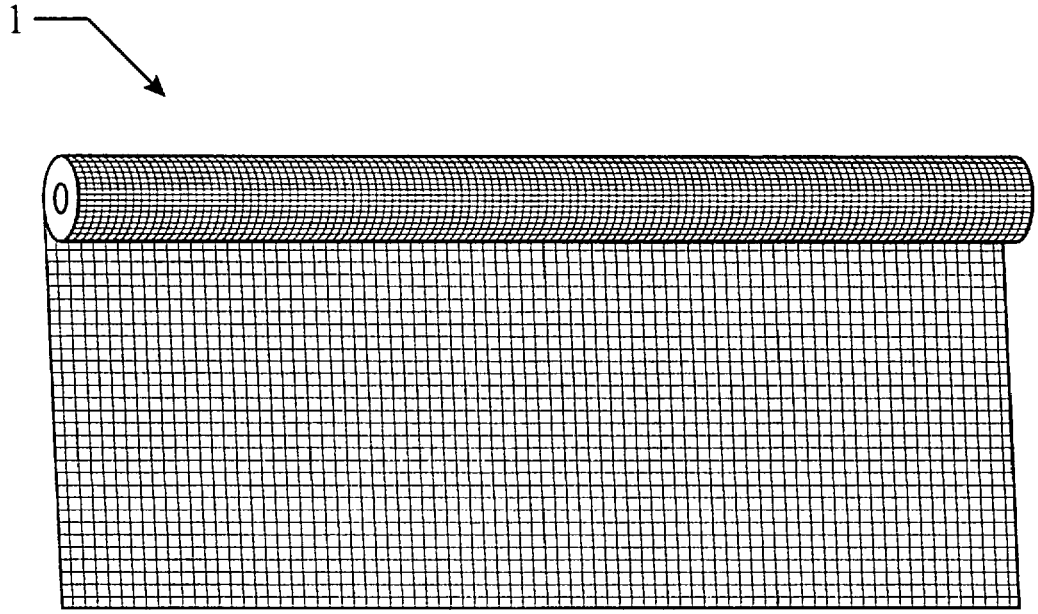
FIG. 1 is a perspective view of a screen roll with a screen portion being rolled out.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary ill the art after review of the following figures an description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

Figure 2:
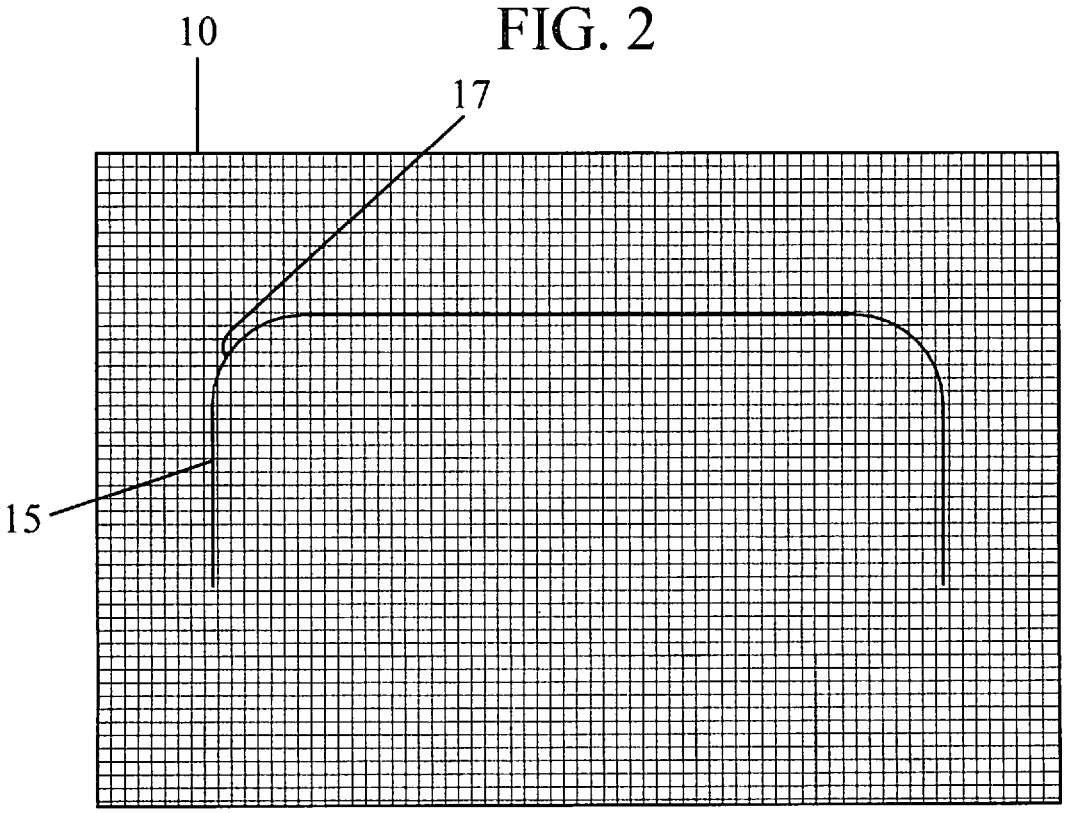
FIG. 2 is a front view of a pre-cut screen panel taken from the screen roll shown in FIG. 1 with a drawn curved line.

1 screen roll with portion being rolled out
10 Sized rectangular screen panel
15 drawn curved line (tracing a flap)
17 convex curved edge
20 zipper
22 top zipper material strip
23 top row of teeth
24 bottom zipper material strip
25 bottom row of teeth
30 double sided tap roll
32 strip of double sided tape
40 sew lines on top and bottom zipper material strips
50 cut line on rear side of panel
62 first zipper pull (slide)
64 cap end on first zipper
66 second zipper pull (slide)
68 cap end on second zipper
90 gutter on roof edge
100 screen enclosure
110 upper frame section
115 spline
120 screen flap/door FIG. 1 is a perspective view of a screen roll 1 with a screen portion being rolled out. The screen roll can be the type of plastic, fiberglass, plastic coated, resin coated and/or metallized screening used screen enclosures for structures such as those around pools, covering patios, decks, and against backs of homes, and the like FIG. 2 is a front view of a pre-cut screen panel 10 taken from the screen roll 1 shown in FIG. 1 with a drawn curved line 15. Screen enclosures are known to use rectangular shaped screen panels attached to frames in the screen enclosures, such as those shown and described in U.S. Pat. No. 2,837,153 to Brown et al. and U.S. Pat. No. 3,374,597 to Whitener which are both incorporated by reference in their entirety. These systems generally have frame sections where generally rectangular shaped screen panels are locked in place by pushing spline against perimeter edges of the screen panel into grooves along the perimeter edges of the frame.

For the invention a frame of a screened enclosure can be picked for the location of the novel screen flap. The installer can cut a rectangular screen panel 10 that would fit the picked frame of the screen enclosure. Such a selected frame can be an upper side frame or top frame of a screen enclosure with a gutter on the outside of the selected frame.

After the frame is selected and screen panel 10 is sized and cut from the roll 1, the installer can mark a curved line 15, by drawing the curved line 15 on a mid portion of a front face of the screen panel 10. The drawn line 15 can have an upwardly extending convex curved edge or convex curved edges 17.

Figure 3:
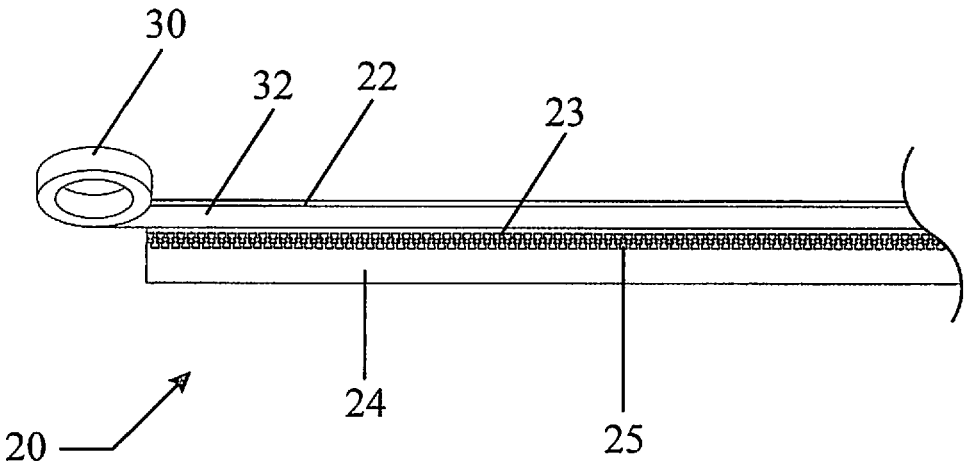
FIG. 3 shows a zipper section with two material strips attached to one another by two rows of teeth with double sided tape being applied to one of the material strips

FIG. 3 shows a zipper section 20 with two material strips 22, 24 attached to one another by two rows of teeth 23, 25 with double sided tape 32 being applied to one of the material strips 22. The double sided tape 32 can come from a double sided tape roll 30. The double sided tape 32 can have peel and stick layers that cover adhesive surfaces.

The type of zipper 20 can be a marine grade zipper such as those used on boats and the like, that is both durable and waterproof, and can have a top zipper material 22 with an edge having a top row of teeth 23, and a bottom row of teeth 25 along one edge of a bottom zipper material 24. The zipper 20 must have at least one curved edge 17 so that the zipper can match and overlay against the drawn curved line 15.

The double sided tape 32 is used to adhere the top and bottom material strips 22, 24 about the drawn curved line 15 on a front side of the screen panel 10.

Figure 4:
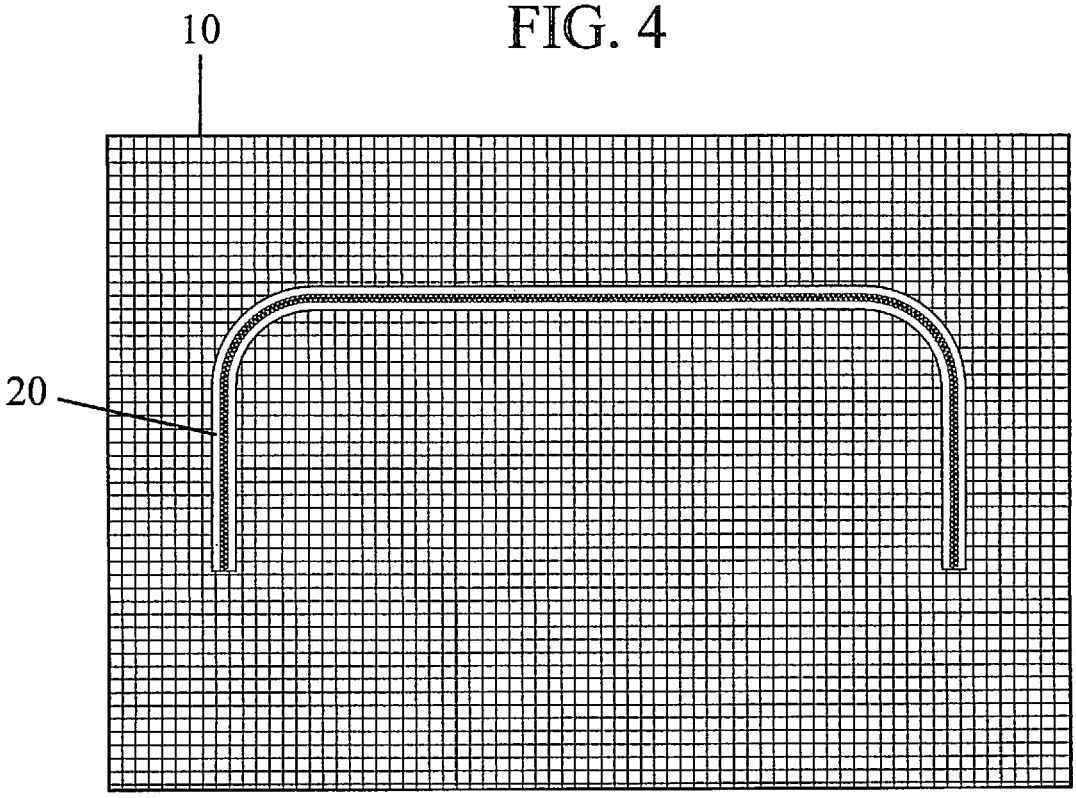
FIG. 4 shows a curved zipper being attached over the drawn curved line on the panel in FIG. 2 using the doubled sided tape of FIG. 3 to stick the zipper on the drawn line.

FIG. 4 shows a curved zipper attached over the drawn curved line on the front of the panel 15 in FIG. 2 using the doubled sided tape 32 of FIG. 3 to stick the zipper over the drawn line 15.

Figure 5:
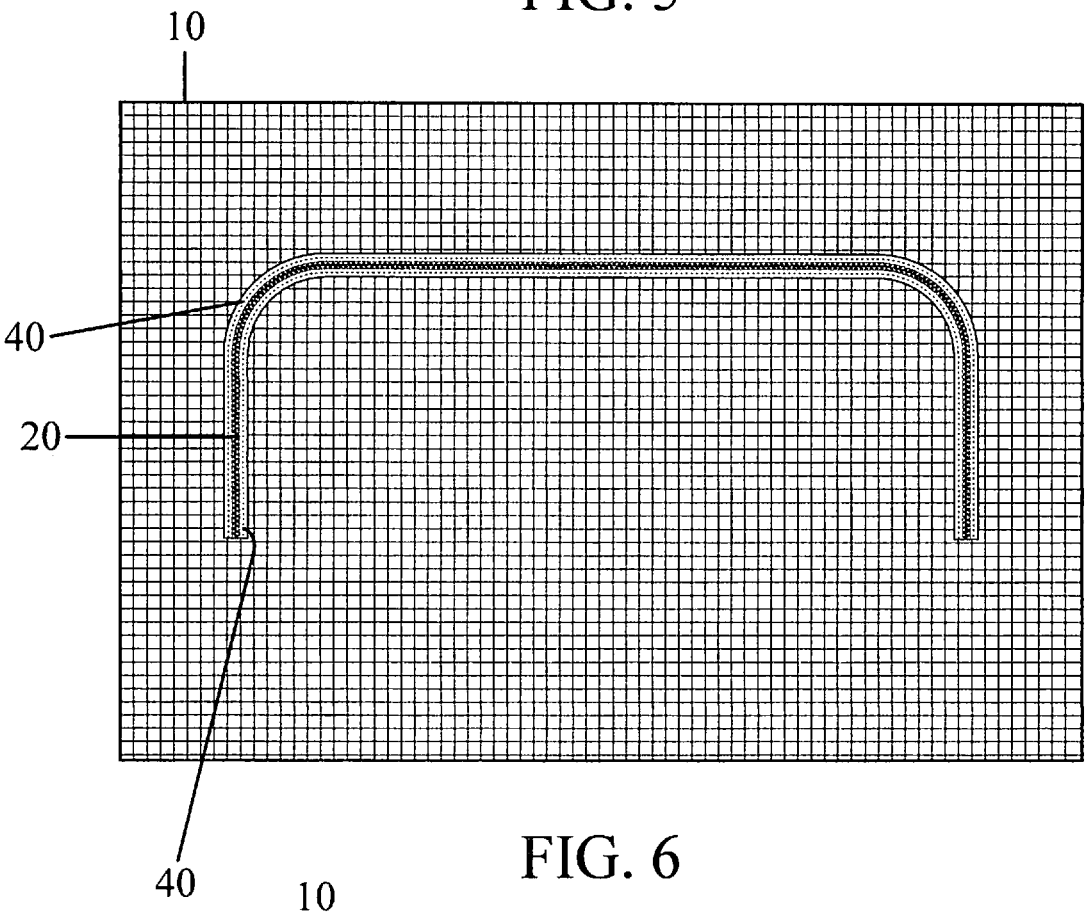
FIG. 5 shows the attached zipper after being sewn in the place on the front of the panel shown in FIG. 4.

Next, the installer can sew the top and bottom material strips 22, 24 on the zipper 20 in place on the front of the screen panel 10. FIG. 5 shows the attached zipper 20 after being sewn in the place on the front of the panel 10 shown in FIG. 4 and the sew lines 40 on the top and bottom strips 22, 24 of the zipper 20.

Figure 6:
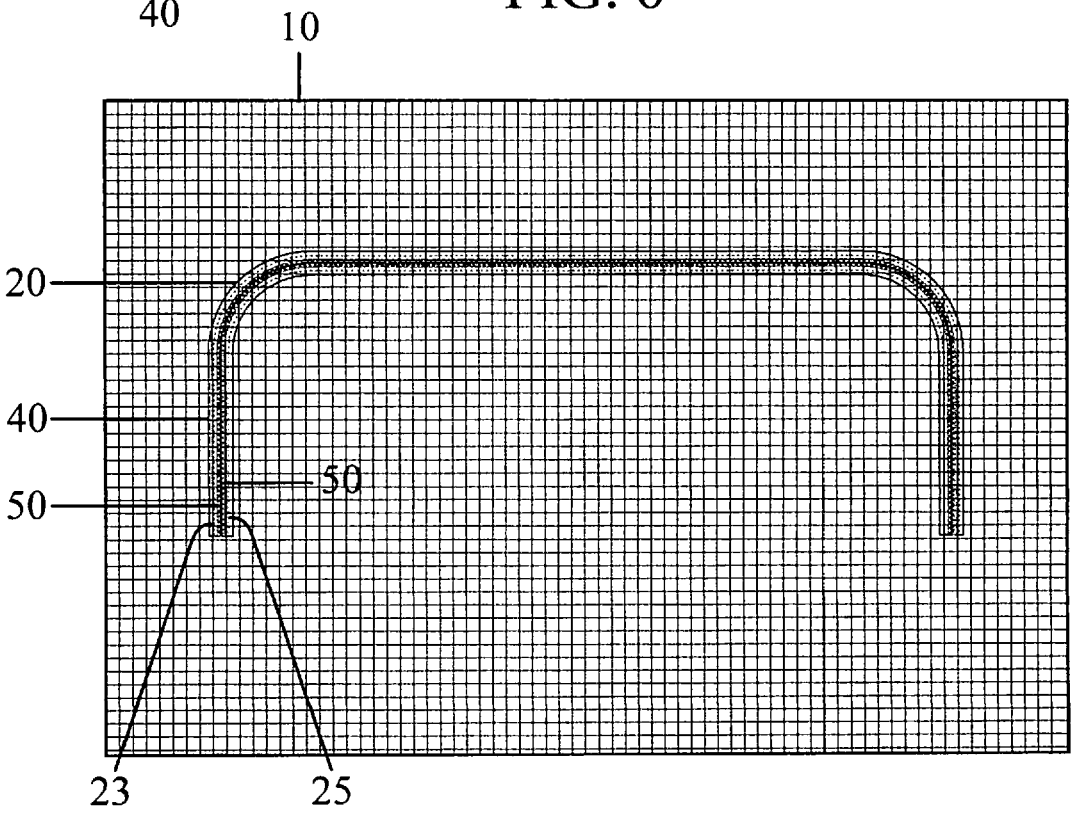
FIG. 6 shows a rear side of the panel of FIG. 5 ready to have a cut line cut between the two rows of zipper teeth.

Next, the installer can make a cut line 50 by a cutting tool, such as a knife, and the like, against the drawn line visible on the rear side of the panel 10. FIG. 6 shows a rear side of the panel 10 of FIG. 5 ready to have a cut line 50 cut between two rows of zipper teeth 23, 25.

Figure 7A:
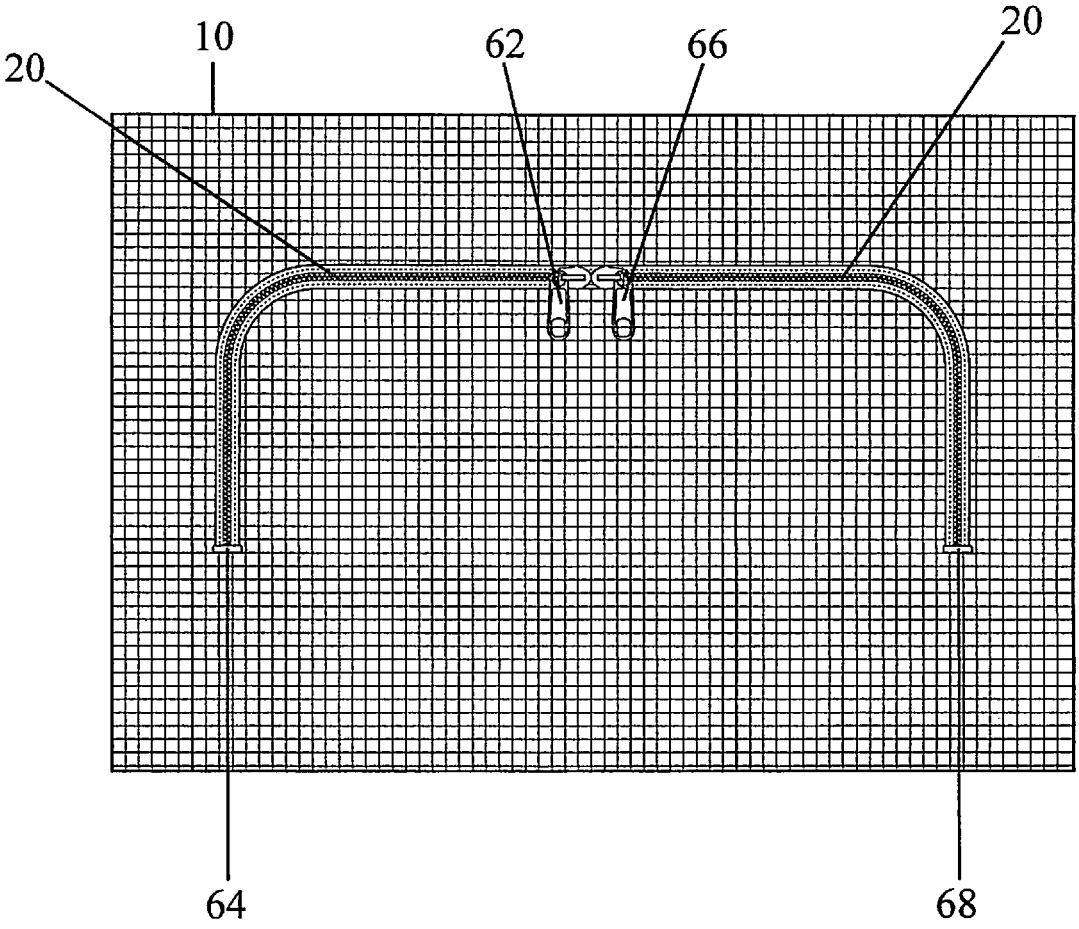
FIG. 7A is a first version of a front side of the panel of FIG. 6 with two zipper pulls installed, and the zipper having capped ends.

FIG. 7A is a first version of a front side of the panel 10 of FIG. 6 with two zipper pulls 62, 64 (slides) installed, and the zipper 20 having capped ends 64, 68 for a finished look.

Figure 7B:
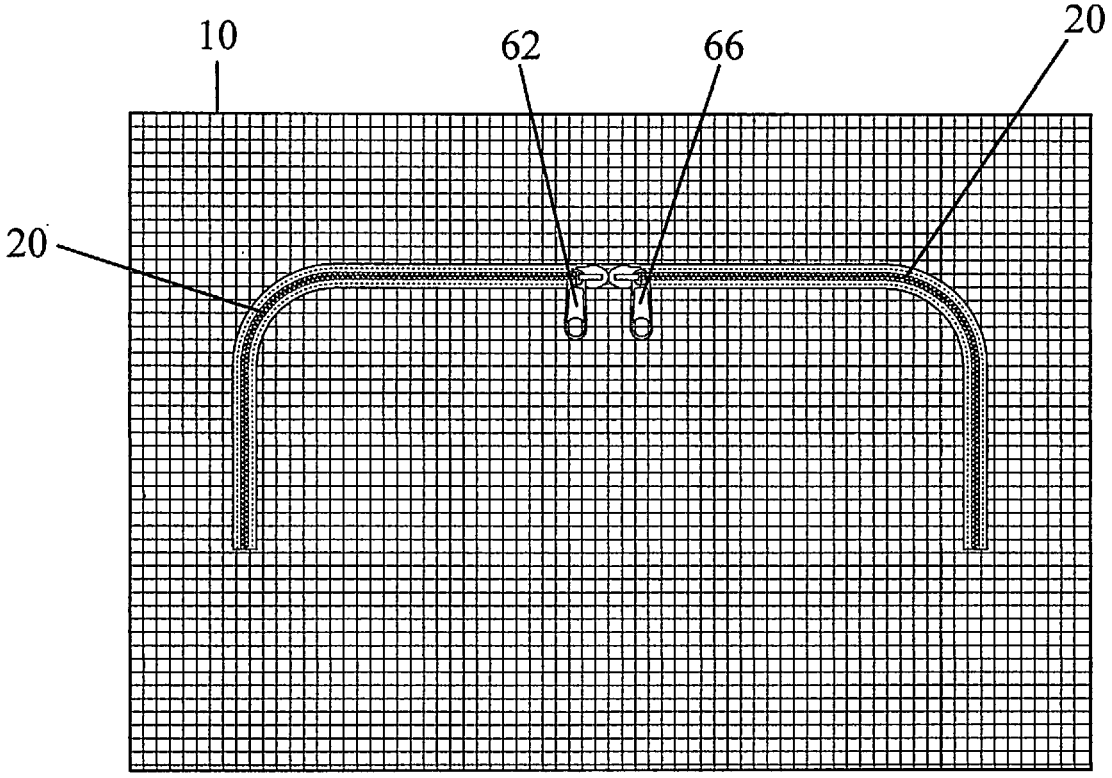
FIG. 7B shows a second version of a front side of the panel of FIG. 6 with two zipper pulls installed with no cap ends.

FIG. 7B shows a second version of a front side of the panel 10 of FIG. 6 with two zipper pulls (slides) 62, 64 installed on a zipper 20 with no cap ends 64, 68.

Figure 8:
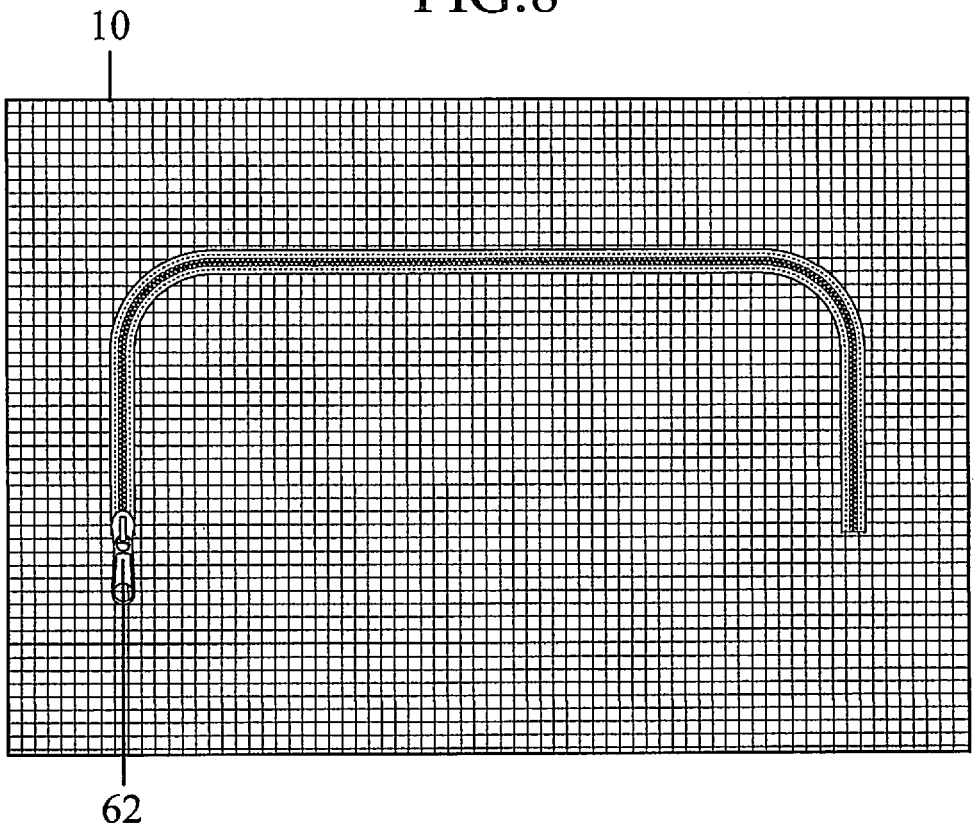
FIG. 8 shows a front side of the panel of FIG. 6 with one zipper pull installed.

FIG. 8 shows a front side of the panel 10 of FIG. 6 with one zipper pull (slide) 62 installed.

Figure 9:
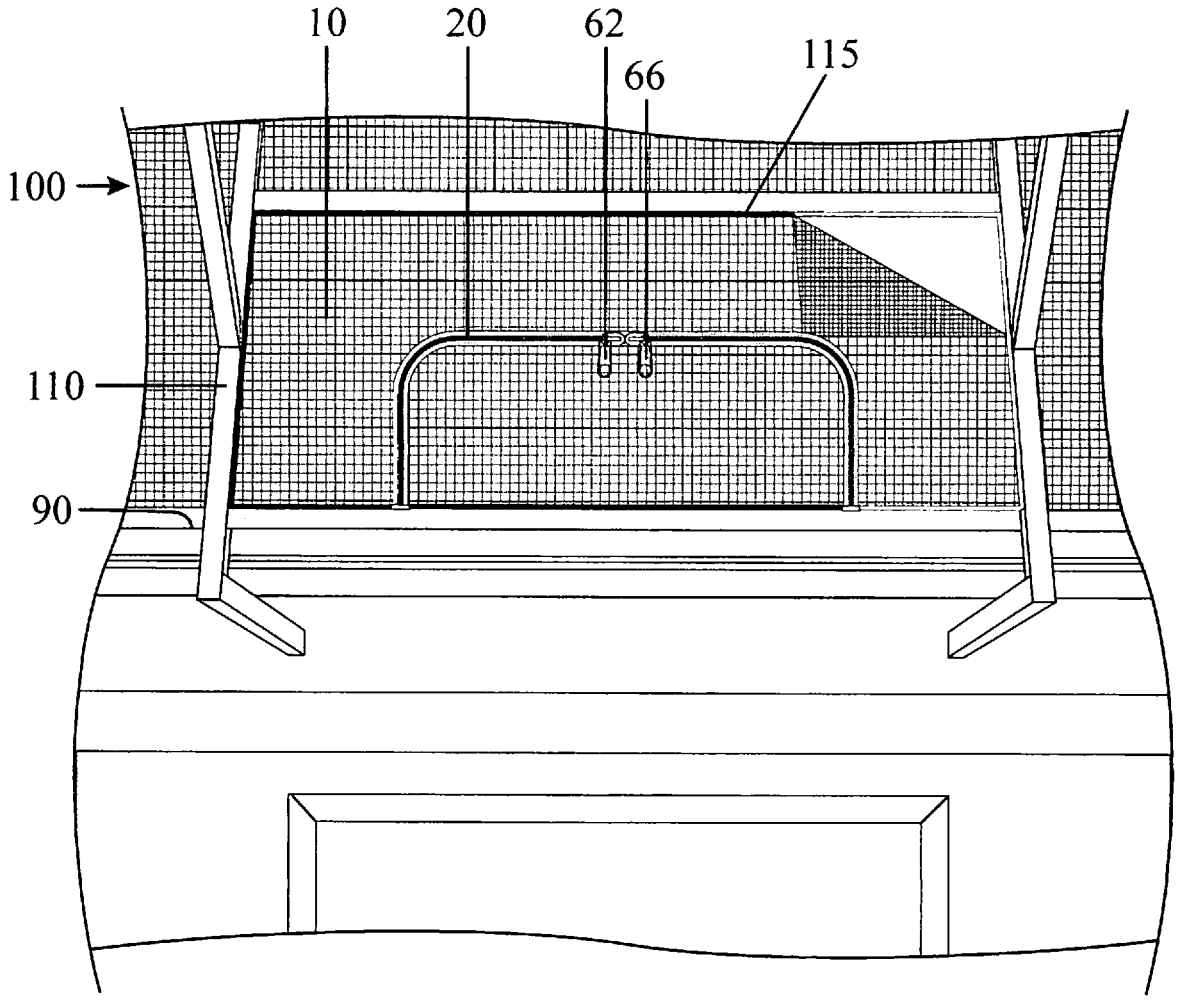
FIG. 9 shows the panel with two zipper pulls of FIG. 7A being installed with spline in a screen enclosure frame adjacent to a roof gutter.

FIG. 9 shows the panel with two zipper pulls (slides) 62, 64 of FIG. 7A being installed with spline 115 in an upper screen frame 110 of a screen enclosure 100 adjacent to a roof gutter 90.

While FIG. 9 implies the spline 115 on the inside of the screen frame 110, spline 115 can be installed into grooves about the frame 110 on the outside of the screen enclosure 100.

Figure 10:
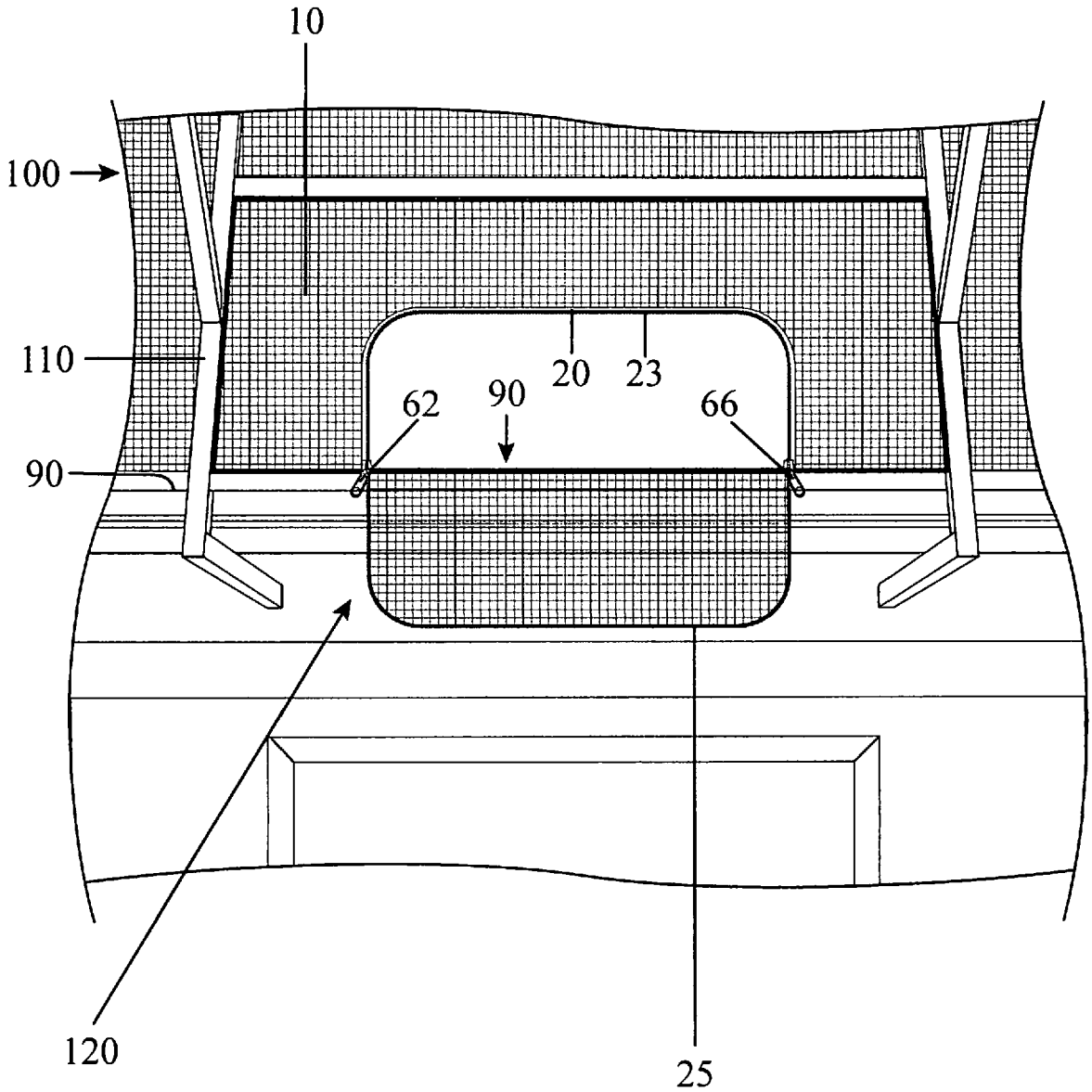
FIG. 10 shows the screen enclosure installed panel of FIG. 9 with both zipper pulls opened to allow the screen flap to fold down inside of the screen enclosure allowing access to the roof gutter on the other side of the screen enclosure.

FIG. 10 shows the screen enclosure installed panel 10 of FIG. 9 with both zipper pulls (slides) 62, 64 opened to allow the screen flap 120 to fold down inside of the screen enclosure 100 allowing access to the roof gutter 90 on the other side of the screen enclosure 100. As discussed, in the background section, the gutter 90 can easily become clogged with debris. The invention allows for a reusable, durable zippered flap that can be easily opened with one or two zipper pulls (slides) 62, 64. The novel flap panel 120 can be easily zipped up when not used. Once the flap panel 120 is zipped, the resulting screen surface becomes under tension similar to the screens under tension in other frame sections of the screen enclosure 100.

Although a preferred embodiment shows using double sided tape to pre-position the curved zipper in place before sewing the zipper to the screen, the invention can have a person physically hold the curved zipper while the zipper is being sewn without using tape, and the like.

While the preferred embodiment describes application of the invention to screen enclosures, the novel invention can be used to create a reusable zipper flap opening in other screen frames, such as in a screen door and/or screen over a window, and the like.

Although the preferred embodiment describes installing the screen panel with the flap opening adjacent a roof section of a screen enclosure, the flap opening can be placed in other locations of the screen enclosure, such as on a wall or adjacent to a floor of the screen enclosure to allow for access between the inside and outside of the screen enclosure.

The novel flap opening can be installed in lower frames of a screen enclosure to be used to allow for passing water lines, hose lines therethrough as well as passing power cords there through, so that the hose lines and power cords do not have to be run by opening doors in the screen enclosure.

While the preferred embodiment shows a flap having an upwardly protruding convex curved top or upwardly protruding convex curved top portions, the flap can be oriented in a substantial U shaped orientation, where the top of the flap is part of the screen (to function as a hinge) and the lower part of the U shape is formed from a zipper. In this configuration and orientation, the flap can be used as another pass through for animals, such as but not limited to dogs, cats, and the like, to be able to pass through when the flap is unzipped.

Although the flaps for the access opening are shown having upper left and upper right convex corners, the flap can have other shapes, such as having one upper convex edge. Other shapes can have the flap having a triangular shape with the apex end having a convex curve, and the like.

Additional variations of the invention can allow for pre-packaging an oversized screen panel with the sewn in curved zipper, as part of a kit, that can include spline, a spline tool, and knife. The kit can allow customers to size the oversized screen panel fit a screen frame so that the novel screen with sewn zipper flap is able to be installed where needed.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A zippered screen flap opening in a screen panel assembly, for attachment to a frame opening in a screen cage, the assembly consisting of:

a generally rectangular screen panel having perimeter edges for being attached to the frame opening in the screen cage, the generally rectangular screen panel having perimeter edges which include left and right outer edges, and top and bottom outer edges;

a flap formed in a mid portion of the generally rectangular screen panel, and spaced away from both the left and right outer edges of the screened panel, and spaced away from the top and bottom outer edges of the screened panel, the flap having at least one upward convex curved edge cut-out through the generally rectangular screen panel, the flap having a bottom edge as part of the screen panel; and a marine grade zipper sewn along the at least one upward convex curved cut-out through the screen panel, wherein the marine grade zipper allows for the flap to fold downward forming an opening through the screen panel when the marine grade zipper is unzipped, and the marine grade zipper when zipped closed causes the flap to close the opening through the screen panel, the marine grade zipper having at least one marine grade zipper pull, the marine grade zipper includes:

a first row of teeth adjacent to a first elongated side strip, a second row of teeth adjacent to a second elongated side strip; and double sided tape for adhering each of the first side strip and the second side strip, wherein each of the first side strip and the second side strip are sewn along adjacent sides of the at least one upward convex curved cut-out in the screen panel; and the assembly includes at least one longitudinal member for locking the perimeter edges of the screened panel to corresponding grooves in the frame of the screens.

2. The zippered screen flap opening in the screen panel assembly of claim 1, wherein the at least one longitudinal member includes:

at least one spline for locking the perimeter edges of the screen panel into corresponding grooves in the frame of the screens, for attaching the screen panel to the frame.

3. The zippered screen flap opening in the screen panel assembly of claim 1, wherein the at least one marine grade zipper pull includes one marine grade zipper pull.

4. The zippered screen flap opening in the screen panel assembly of claim 1, wherein the at least one marine grade zipper pull includes two marine grade zipper pulls.

5. The zippered screen flap opening in the screen panel assembly of claim 1, wherein the at least one upward convex curved cut-out includes one upward convex curved cut-out.

6. The zippered screen flap opening in the screen panel assembly of claim 1, wherein the at least one upward convex curved cut-out includes two upward convex curved cut-outs.

7. A zippered access panel for a screen enclosure, consisting of:

a screen panel sized for a selected frame opening in a screen enclosure, the screen panel having perimeter edges which include left and right outer edges, and a top and bottom outer edge;

a flap formed in a mid portion of the screen panel, and spaced away from both the left and right outer edges of the screened panel, and spaced away from the top and bottom outer edges of the screened panel, the flap having at least one upward convex curved edge cut-out through screen panel, and a curved marine grade zipper sewn along the at least one upward convex curved edge cut-out in the mid-portion of the screen panel, the marine grade curved zipper includes:

a first row of teeth adjacent to a first elongated side strip, a second row of teeth adjacent to a second elongated side strip; and double sided tape for adhering each of the first side strip and the second side strip, wherein each of the first side strip and the second side strip are sewn along adjacent sides of the at least one upward convex curved cut-out in the screen panel.

8. The zippered access panel of claim 7, wherein the marine grade zipper includes one marine grade zipper pull.

9. The zippered access panel of claim 7, wherein the marine grade zipper includes two marine grade zipper pulls.

10. A zippered access panel assembly for a screen enclosure, consisting of:

a screen panel sized for a selected frame opening in a screen enclosure, the screen panel having perimeter edges which include left and right outer edges, and top and bottom outer edges;

a flap formed in a mid portion of the screen panel, and spaced away from both the left and right outer edges of the screened panel, and spaced away from the top and bottom outer edges of the screened panel, the flap having at least one upward convex curved edge cut-out through the screen panel, and a curved marine grade zipper sewn along the at least one upward convex curved edge cut-out in the mid-portion of the screen panel, the curved marine grade zipper includes:

a first row of teeth adjacent to a first elongated side strip, a second row of teeth adjacent to a second elongated side strip; and double sided tape for adhering each of the first side strip and the second side strip, wherein each of the first side strip and the second side strip are sewn along adjacent sides of the at least one upward convex curved cut-out in the screen panel; and the assembly includes at least one spline for locking the perimeter edges of the screened panel to corresponding grooves in a frame of screens.

11. The zippered access panel assembly of claim 10, wherein the marine grade zipper includes one marine grade zipper pull.

12. The zippered access panel assembly of claim 10, wherein the marine grade zipper includes two marine grade zipper pulls.

* * * * *